US007836972B2

(12) United States Patent
Pavlik

(10) Patent No.: US 7,836,972 B2
(45) **Date of Patent: *Nov. 23, 2010**

(54) MOBILE SOIL SAMPLING DEVICE WITH VACUUM COLLECTOR

(76) Inventor: John L. Pavlik, 86619 520th St., Royal, NE (US) 68773

( * ) Notice: Subject to any disclaimer, the term of this patent is extended or adjusted under 35 U.S.C. 154(b) by 81 days.

This patent is subject to a terminal disclaimer.

(21) Appl. No.: 12/319,789

(22) Filed: Jan. 12, 2009

(65) Prior Publication Data

US 2009/0178853 A1 Jul. 16, 2009

Related U.S. Application Data

(63) Continuation-in-part of application No. 12/008,441, filed on Jan. 11, 2008, now Pat. No. 7,575,069.

(51) Int. Cl.
*E21B 11/02* (2006.01)
*G01N 1/04* (2006.01)

(52) U.S. Cl. ..... 175/20; 175/332; 175/210; 175/122; 175/162; 173/185; 73/864.43; 73/864.44; 73/864.45; 73/432.1

(58) Field of Classification Search ..... 175/20, 175/84, 323, 210, 211, 213; 73/864.43–864.45, 73/432.1; 173/185
See application file for complete search history.

(56) References Cited

U.S. PATENT DOCUMENTS

| | | | | |
|---|---|---|---|---|
| 4,807,707 | A | 2/1989 | Handley et al. | |
| 5,394,949 | A * | 3/1995 | Wright et al. | 175/20 |
| 5,411,087 | A | 5/1995 | Taylor | |
| 5,921,328 | A | 7/1999 | Babineau et al. | |
| 6,360,829 | B1 | 3/2002 | Naber et al. | |
| 6,363,803 | B1 * | 4/2002 | Hubers | 73/864.43 |
| 7,216,555 | B2 | 5/2007 | Drummond et al. | |
| 7,255,016 | B2 | 8/2007 | Burton | |
| 7,575,069 | B2 * | 8/2009 | Pavlik | 175/20 |
| 2004/0089479 | A1 * | 5/2004 | Snyder, Sr. | 175/84 |

* cited by examiner

*Primary Examiner*—Jennifer H Gay
*Assistant Examiner*—Yong-Suk Ro
(74) *Attorney, Agent, or Firm*—Dennis L. Thomte; Thomte Patent Law Office LLC

(57) ABSTRACT

A mobile soil sampling device is mounted on the side of a vehicle such as an ATV or UTV and includes an upstanding frame member which is vertically movable with respect to the vehicle by means of a parallel arm linkage and actuator. A vertically disposed and rotatable auger is mounted on the frame member and is moved upwardly and downwardly with respect thereto through the use of a motor and pinion gear with the pinion gear engaging a gear rack on the frame member. The auger is rotated so as to dig into the ground to the desired depth with the soil sample being conveyed upwardly into a vacuum collection chamber with the soil sample being conveyed to a vacuum chamber mounted on the vehicle. A sample collection device is mounted beneath the vacuum chamber for receiving the desired soil samples. An auger flute cleaning apparatus is mounted on the device to remove soil from the flutes of the auger as the auger is raised from a soil penetration position. The soil removed from the auger by the flute cleaning apparatus drops downwardly into the collection chamber.

15 Claims, 14 Drawing Sheets

MOBILE SOIL SAMPLING DEVICE WITH VACUUM COLLECTOR

CROSS REFERENCE TO RELATED APPLICATION

This is a continuation-in-part application of Petitioner's earlier application Ser. No. 12/008,441, filed Jan. 11, 2008, now U.S. Pat. No. 7,575,069 entitled MOBILE SOIL SAMPLING DEVICE WITH VACUUM COLLECTOR.

BACKGROUND OF THE INVENTION

1. Field of the Invention

This invention relates to a mobile soil sampling device and more particularly to a mobile soil sampling device which is attached to one side of a wheeled vehicle such as an ATV or UTV and which has a vacuum collector associated therewith for collecting soil samples. More particularly, this invention relates to a soil sampling device including a soil auger and even more particularly to an auger flute cleaning apparatus which removes soil from the flutes of the soil auger as the soil auger is raised from its soil sampling position.

2. Description of the Related Art

Many types of soil sampling devices have been previously provided and many types of mobile soil sampling devices that are attached to a vehicle have been previously provided. However, the prior art devices have many shortcomings. First, most of the soil sampling devices of which applicant has knowledge do not have any means for ensuring that the soil sampling auger or coring device will be substantially vertically disposed when moved into its operative drilling position. Further, the mobile soil sampling devices of which applicant has knowledge do not have efficiently operable vacuum collectors thereon which convey the soil samples to a vacuum chamber. Still another disadvantage of the prior art devices is that they apparently do not have any means for individually collecting soil samples from different depths in the soil. Still another disadvantage of the prior art devices is that none of the prior art devices utilize a vacuum collection system wherein the amount of intake air is selectively adjustable. Further, the prior art devices do not have a soil collector including means for packing the loose surface soil around the soil auger or core so that it does not contaminate the sample. Yet another disadvantage of the prior art is that none of the prior art devices of which applicant has knowledge include a means for functioning as an outrigger foot.

The soil sampling device of the application represents a vast improvement over the prior art soil sampling devices. The instant invention represents even a further improvement in that the instant invention eliminates the need for the operator to manually remove soil from the auger flutes after a soil sample has been augered upwardly to the soil collector to prevent contamination of subsequent soil samples.

SUMMARY OF THE INVENTION

A soil sampling device is described for use with a wheeled vehicle such as an ATV or a UTV. An upstanding mast is attached to the vehicle and has upper and lower ends with the mast having vertically spaced-apart upper and lower parallel arm linkages secured thereto with each of the linkages having inner and outer ends. The inner ends of the upper and lower parallel arm linkages are pivotally secured, about horizontal axes, to the upstanding mast with the linkages extending outwardly with respect to the vehicle. A vertically disposed elongated first frame member is positioned outwardly of the mast and has upper and lower ends. The outer ends of the upper and lower parallel arm linkages are pivotally secured to the first frame member about horizontal axes. An actuator is connected to at least one of the parallel arm linkages to enable the first frame member to be vertically moved between upper and lower positions with respect to the mast and the ground.

A first support is selectively vertically movably mounted on the first frame member and is movable between upper and lower positions with respect to the first frame member. A first motor is mounted on the first support which is adapted to selectively vertically move the first support with respect to the first frame member. A second support is rigidly affixed to the first frame member adjacent the lower end thereof. An elongated vertically disposed auger, having upper and lower ends, has its upper end operatively rotatably secured, about a vertical axis, to the first support. A second motor is mounted on the first support which is adapted to selectively rotate the auger.

A vertically disposed, cylindrical soil collecting chamber, having upper and lower ends, is mounted on the second support and is movable therebetween. The auger vertically movably extends through the soil collecting chamber whereby the soil augered upwardly by the auger will be collected in the soil collecting chamber. The soil collecting chamber includes an adjustable air inlet at one side thereof.

An elongated vacuum conduit having an inlet and a discharge end is provided with the inlet end of the vacuum conduit being in communication with the interior of the soil collecting chamber. A vacuum soil collecting device is mounted on the vehicle and is adapted to create a vacuum in the vacuum conduit and the soil collection chamber. The discharge end of the vacuum conduit is in communication with the vacuum soil collection device whereby soil collected in the vacuum collection chamber through the action of the auger will be conveyed to the vacuum soil collection device.

A carousel is rotatably secured to the vacuum soil collection device about a vertical axis and has a plurality of radially spaced-apart openings formed therein which are adapted to be moved into register with the open lower end of the vacuum soil collection device. A soil collection container is positioned on the carousel below each of the openings formed therein and is adapted to receive soil samples therein. Each of the containers positioned on the container have a trap door provided at the lower end thereof which enables the soil samples therein to be easily removed.

The actuator which is connected to at least one of the parallel arm linkages is operable to enable the frame member to be moved to its lower position so that the lower end thereof is in ground engagement with the auger then being actuated to drill a predetermined depth into the ground so that the flights thereon will convey the soil sample upwardly into the cylindrical soil collecting chamber. The soil samples delivered to the soil collecting chamber are vacuum conveyed to the vacuum soil collection device with the carousel being selectively rotated so that the soil sample will be delivered to the proper container mounted on the carousel.

In a modified form of the invention, an auger flute cleaning apparatus is mounted on the second support and vertically movably receives the auger extending therethrough. The flute cleaning apparatus removes soil from the flutes of the auger as the auger is moved upwardly from its soil sampling position. The soil removed from the flutes of the auger falls downwardly into the soil collection chamber. The auger flute cleaning apparatus of this invention prevents the contamination of subsequent samples.

It is therefore a principal object of the invention to provide an improved mobile soil sampling device.

Still another object of the invention is to provide an improved mobile soil sampling device which includes a vacuum collector.

Still another object of the invention is to provide a mobile soil sampling device which is mounted at one side of a wheeled vehicle such as an ATV or UTV by way of a parallel arm linkage.

Still another object of the invention is to provide a mobile soil sampling device which includes means for individually collecting soil samples from different depths in the soil.

Still another object of the invention is to provide a mobile soil sampling device with a vacuum collector including an adjustable air inlet.

Still another object of the invention is to provide a mobile soil sampling device which includes means for packing the loose soil surface around the soil auger so that it does not contaminate the sample.

Still another object of the invention is to provide a mobile soil sampling device which includes an outrigger foot.

Still another object of the invention is to provide a mobile soil sampling device with a vacuum collector which is easily attached to one side of an ATV or UTV without substantial modification thereof.

Yet another object of the invention is to provide an auger flute cleaning apparatus which removes soil from the flutes of the soil sampling auger as the auger is raised from its soil sampling position to prevent contamination of the next sample.

These and other objects will be apparent to those skilled in the art.

DESCRIPTION OF THE PREFERRED EMBODIMENT

Figure 11:
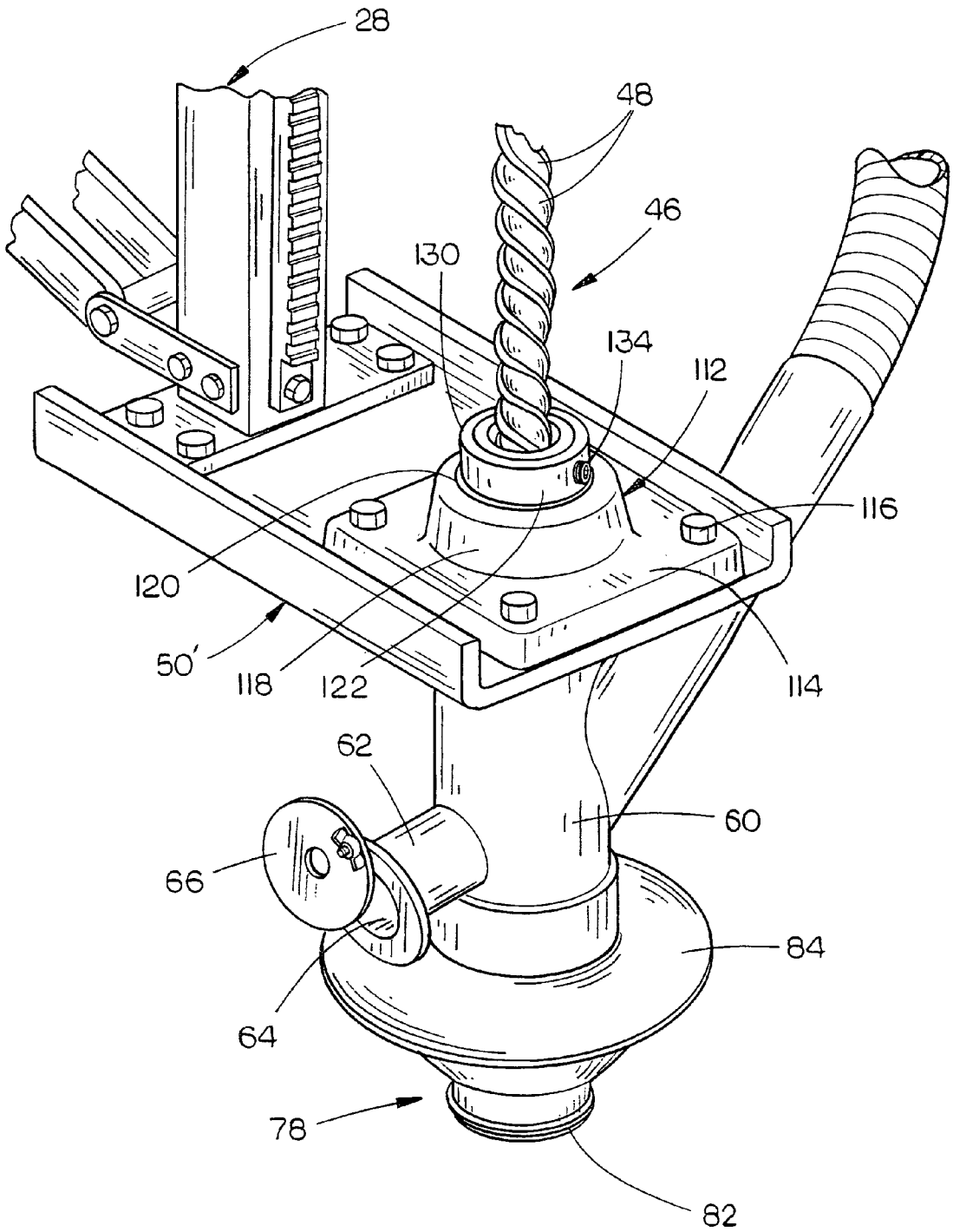
FIG. 11 is a perspective view of the auger flute cleaning apparatus of a modified form of the invention.
Figure 12:
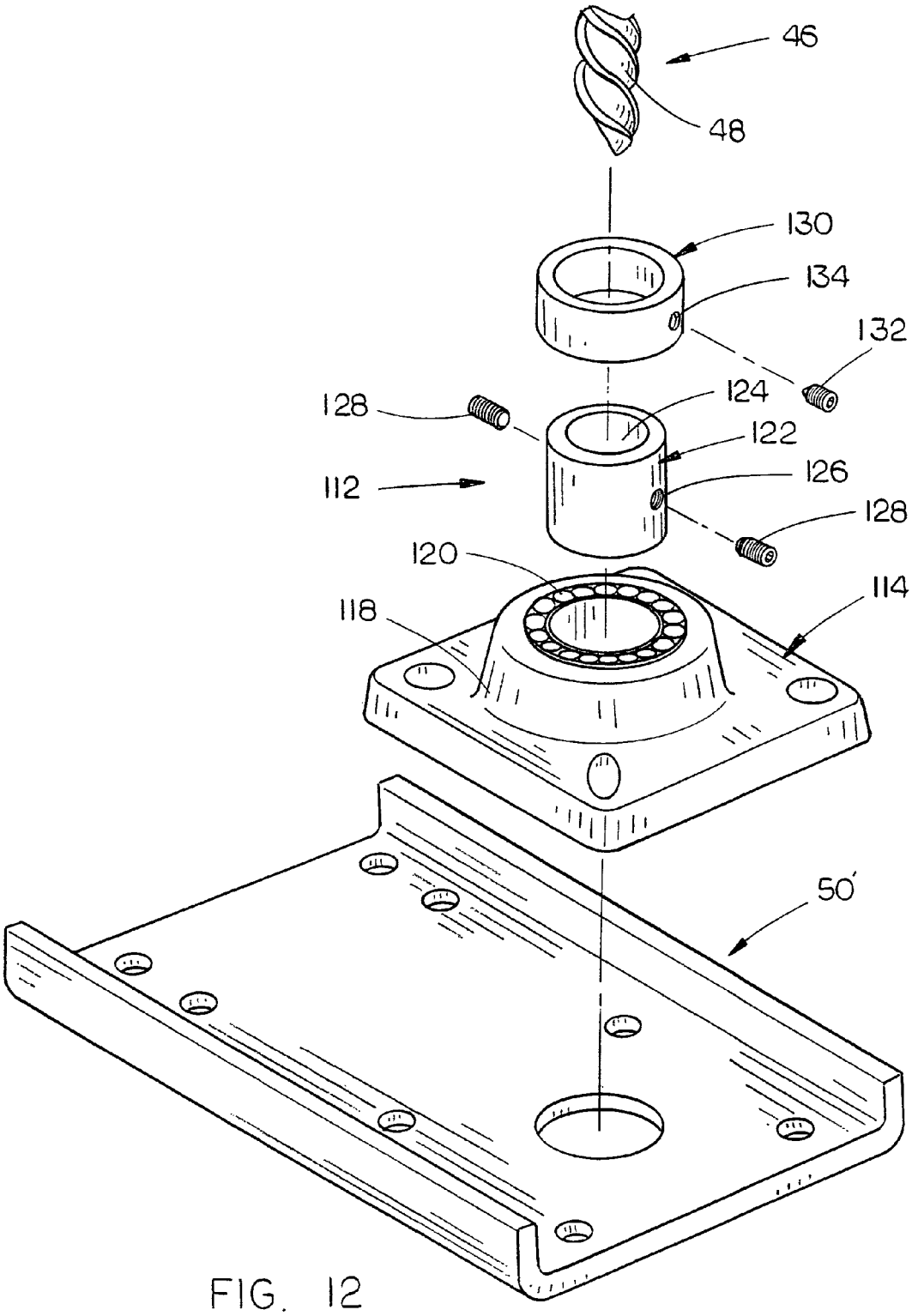
FIG. 12 is an exploded perspective view of the auger flute cleaning apparatus of FIG. 11.
Figure 13:
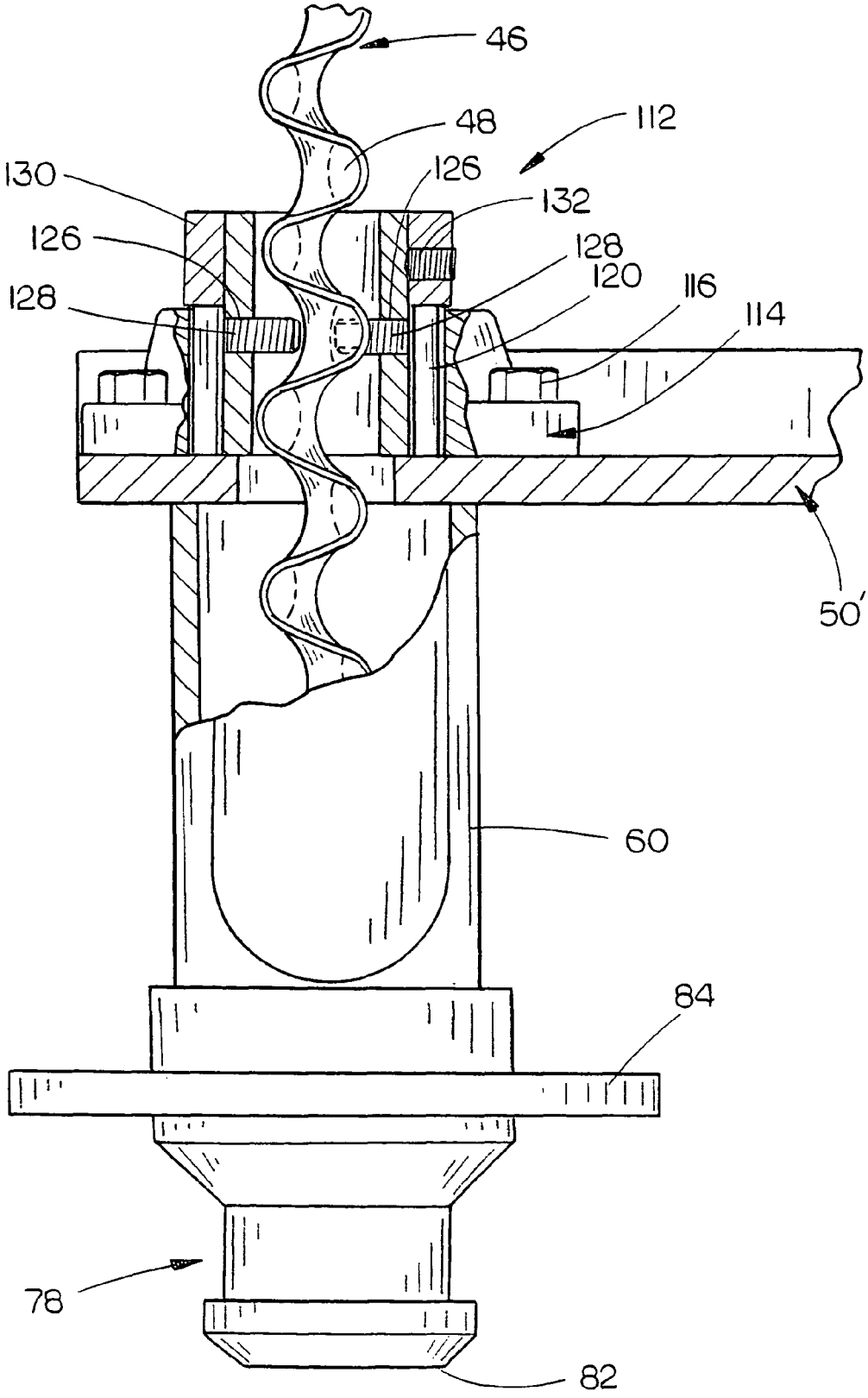
FIG. 13 is a side view of the auger flute cleaning apparatus of FIG. 11 with portions thereof cut-away to more fully illustrate the invention.
Figure 14:
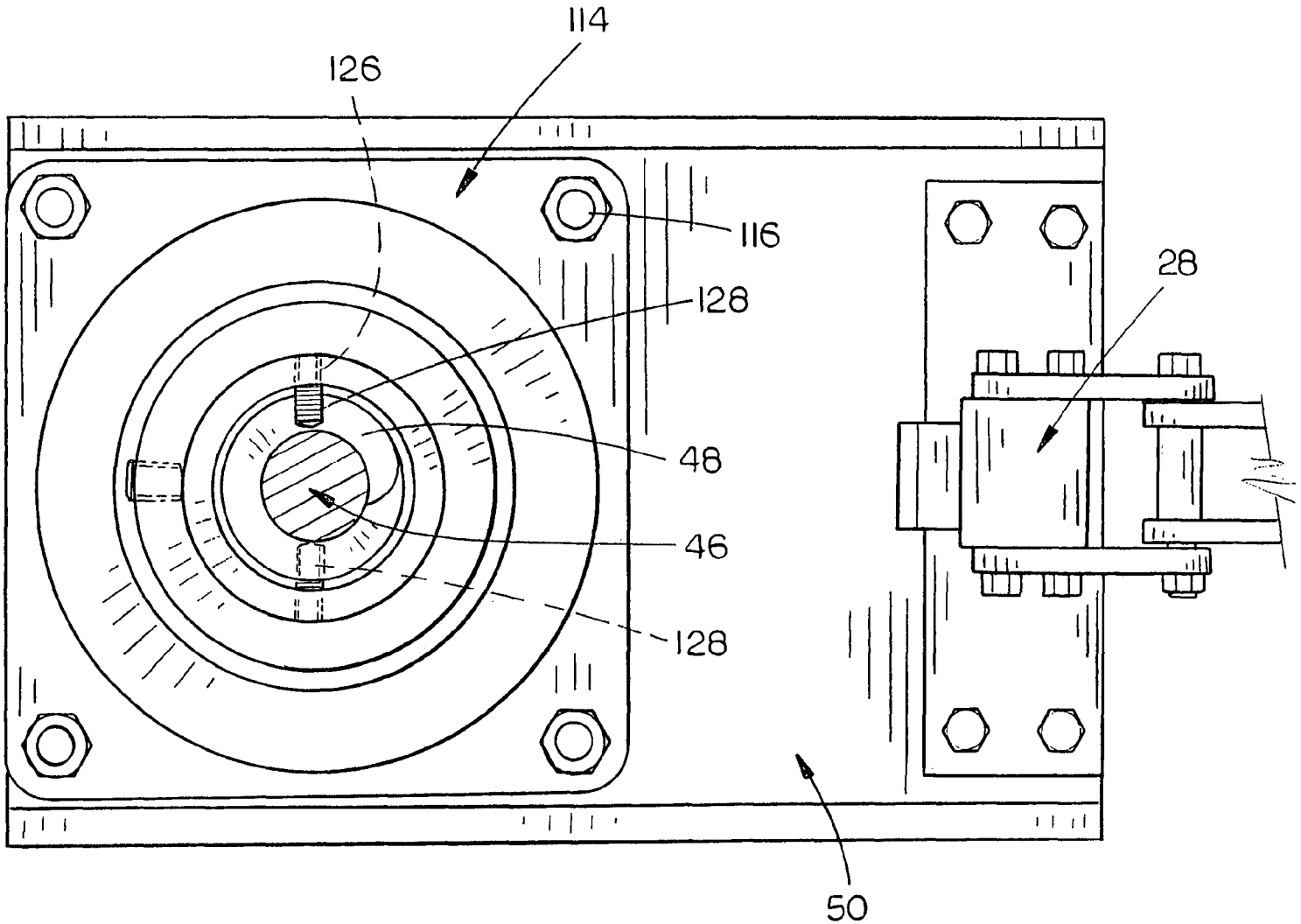
FIG. 14 is a top view of the auger flute cleaning apparatus of FIG. 11.

With respect to FIGS. 1-10, the numeral 10 refers to the mobile soil sampling device of the invention described in the co-pending application which is mounted on a wheeled vehicle such as a truck, tractor, an all terrain vehicle (ATV) or a utility vehicle (UTV) 12. In many cases the vehicle 12 includes a roll bar frame 14 which provides a convenient mount for the soil sampling device. FIG. 11 illustrates a means for cleaning the flutes of the soil sampling auger of the invention as will be described in more detail hereinafter.

Device 10 includes a vertically disposed frame member or mast 16 which is secured to the roll bar frame 14 by any convenient means such as clamps or the like. An upper parallel arm linkage 18 is pivotally connected at its inner end to mast 16 adjacent the upper end thereof by a pivot pin 20. A lower parallel arm linkage 22 is pivotally connected at its inner end to mast 16 adjacent the lower end thereof by a pivot pin 24. Parallel arm linkages 18 and 22 form a parallel arm linkage assembly which is referred to by the reference numeral 26.

Figure 1:
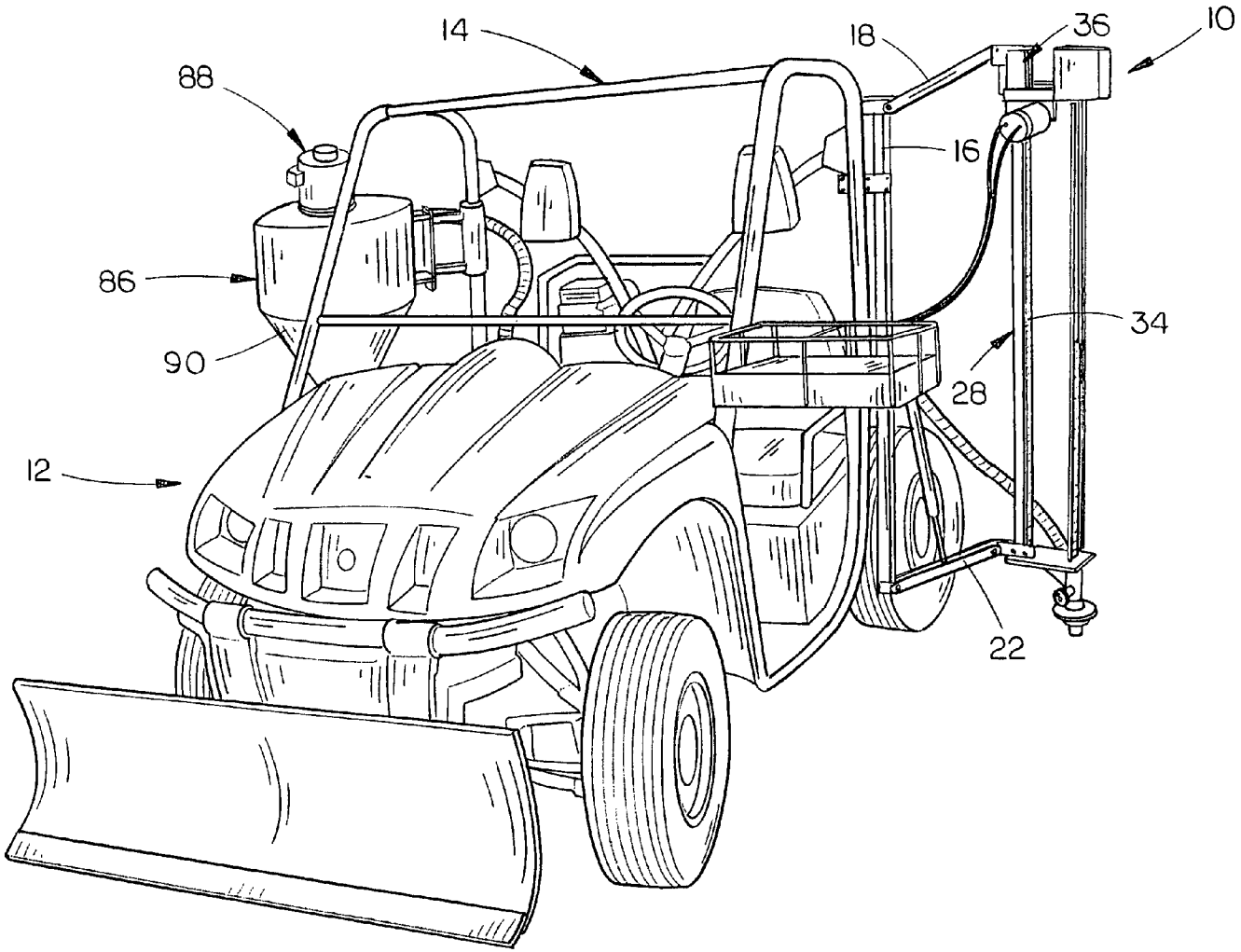
FIG. 1 is front perspective view of a vehicle having the soil sampling device of this invention mounted thereon.
Figure 2:
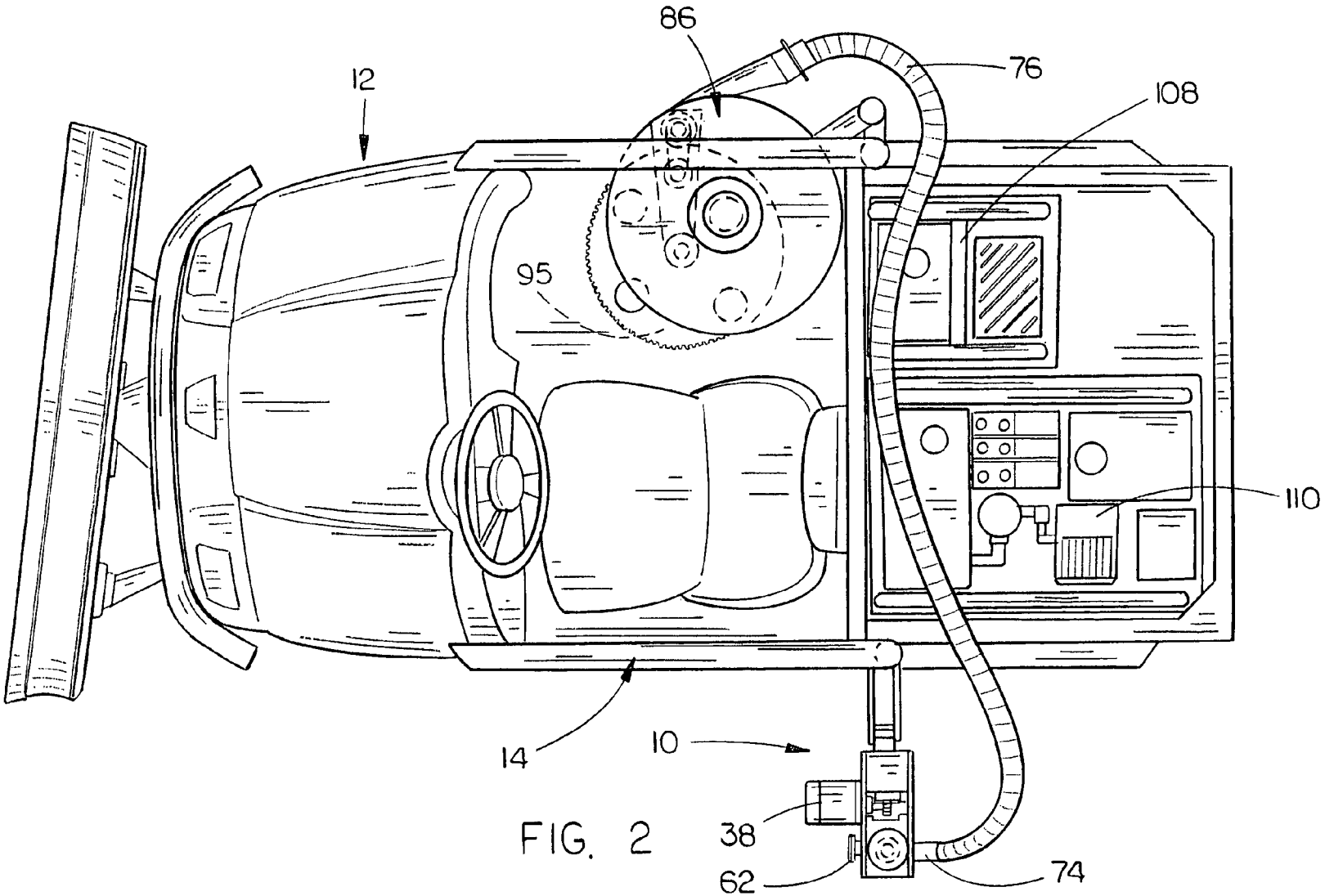
FIG. 2 is a top view of the vehicle and soil sampling device of FIG. 1.
Figure 3:
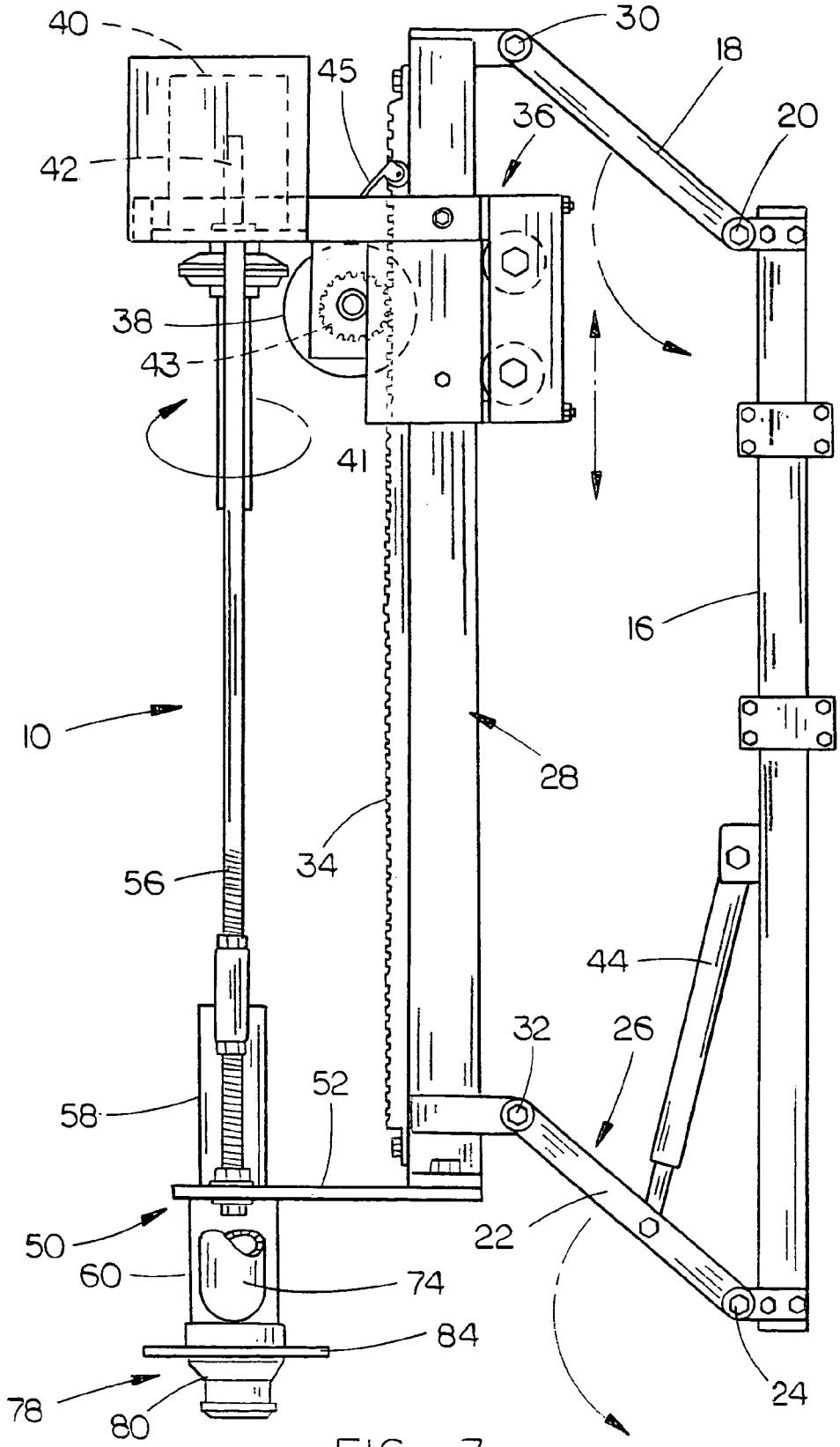
FIG. 3 is a partial rear view of the device.
Figure 4:
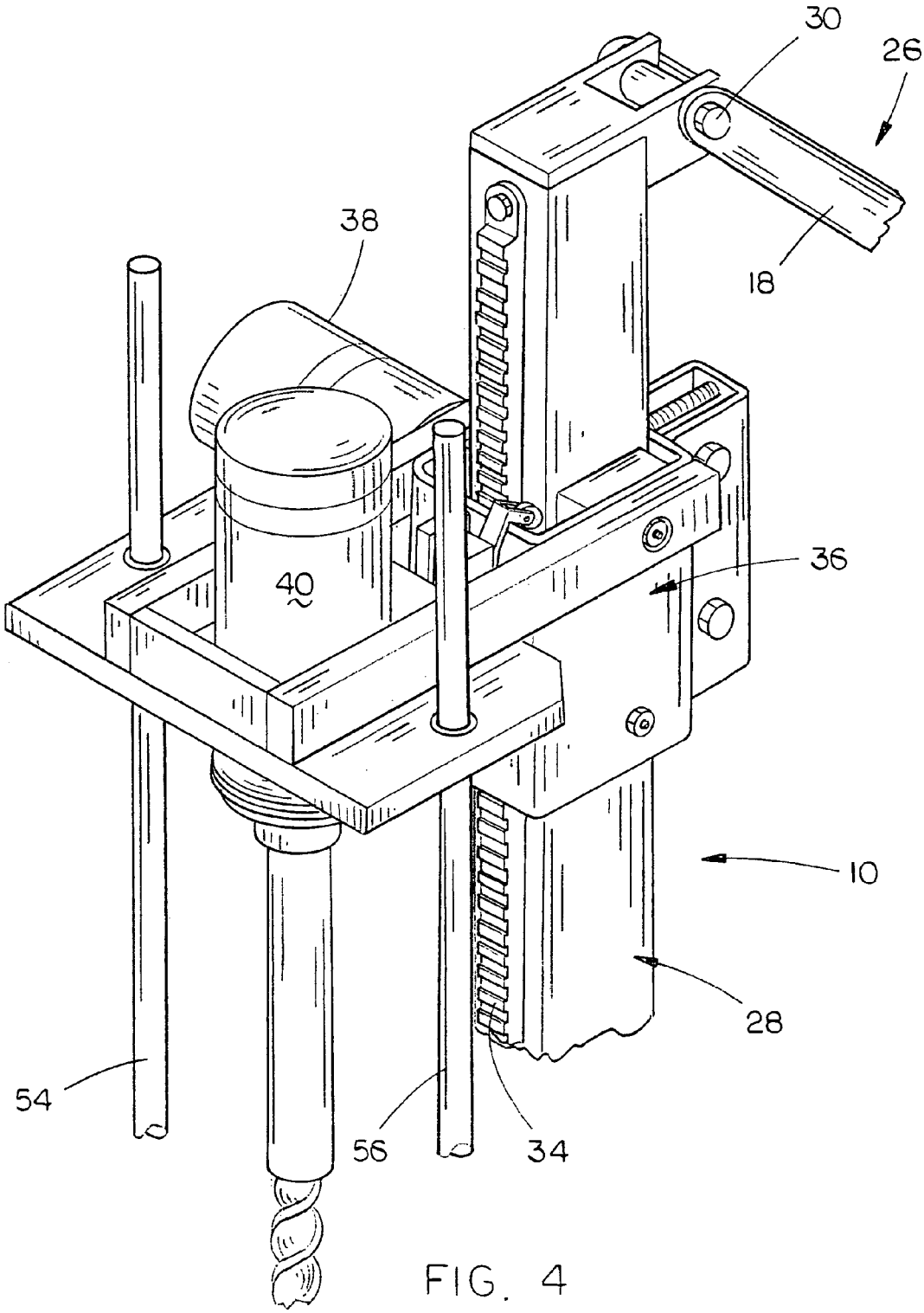
FIG. 4 is a partial perspective view of the upper end of a portion of the device of this invention.
Figure 5:
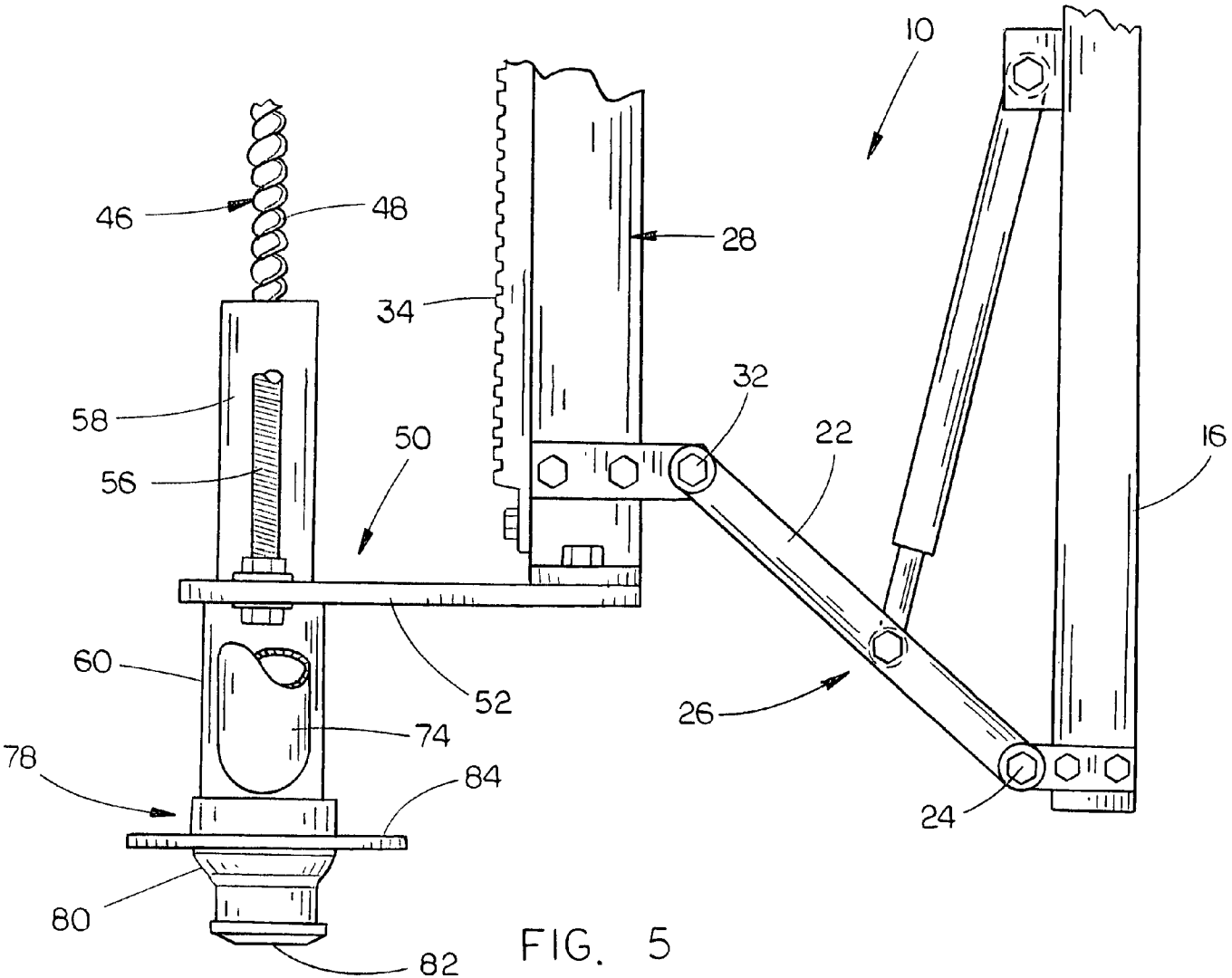
FIG. 5 is partial rear view of the lower portion of the device of this invention.
Figure 6:
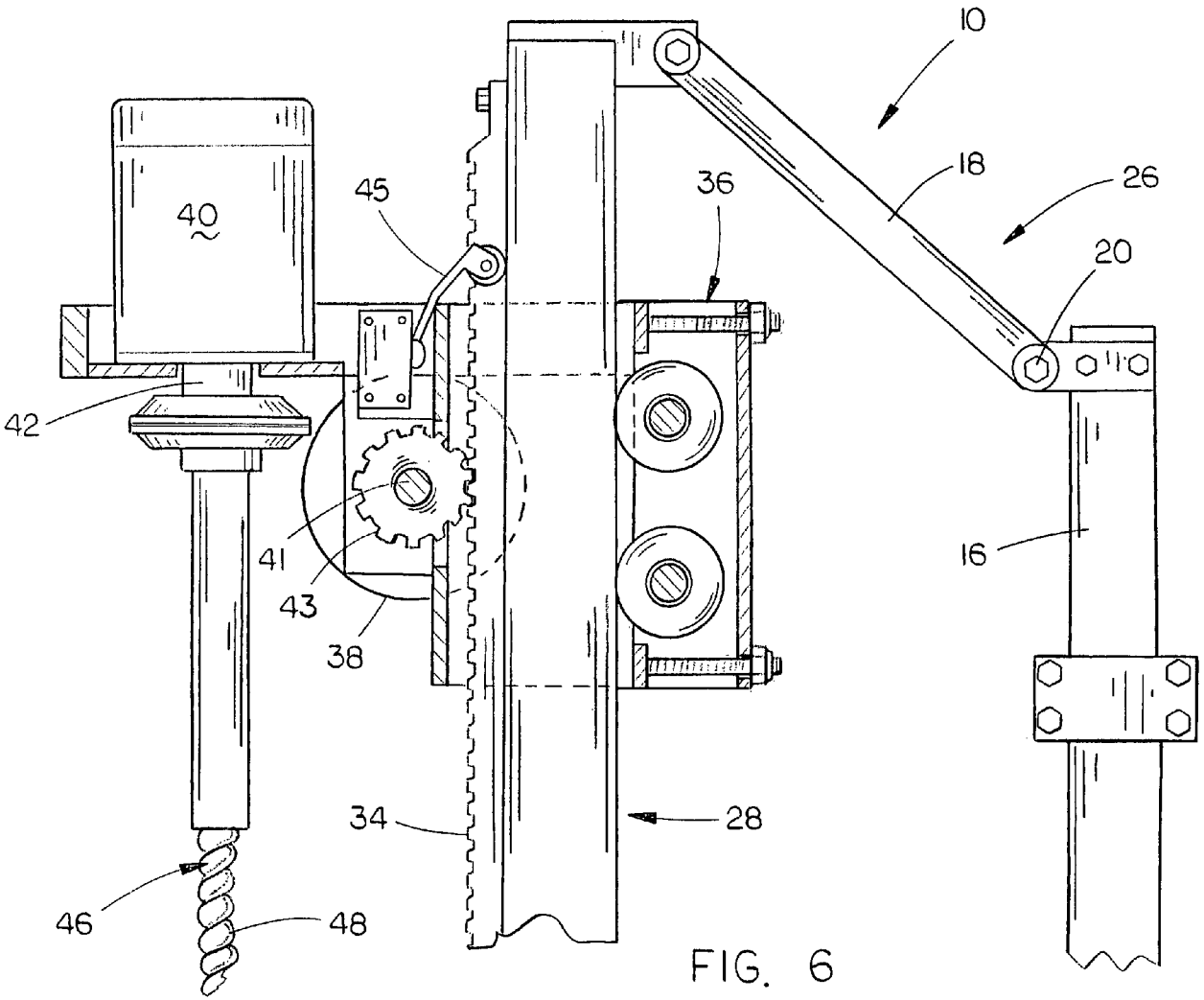
FIG. 6 is a rear view of the upper portion of the device of this invention.
Figure 7:
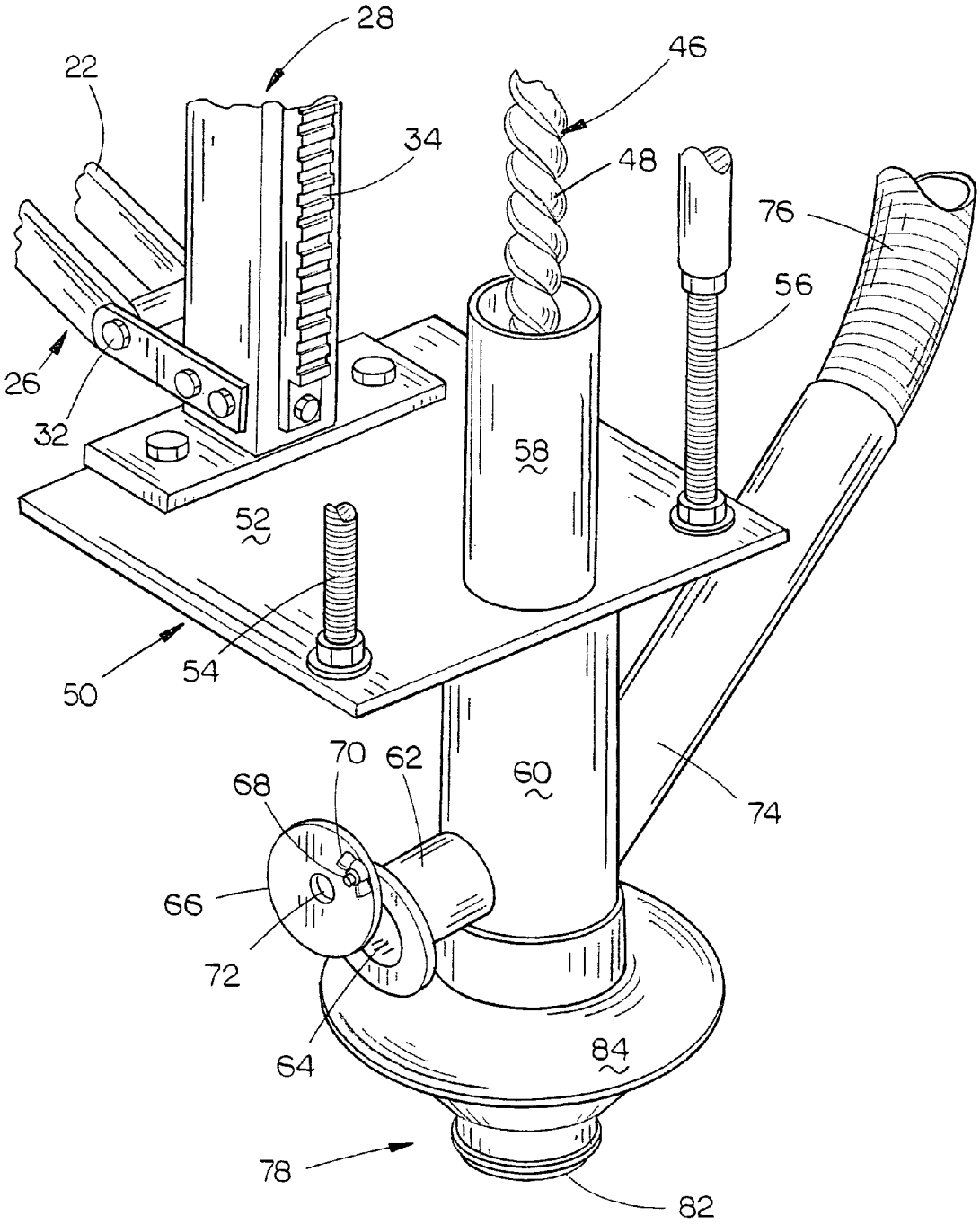
FIG. 7 is a partial perspective view of the lower end of the device of this invention.
Figure 8:
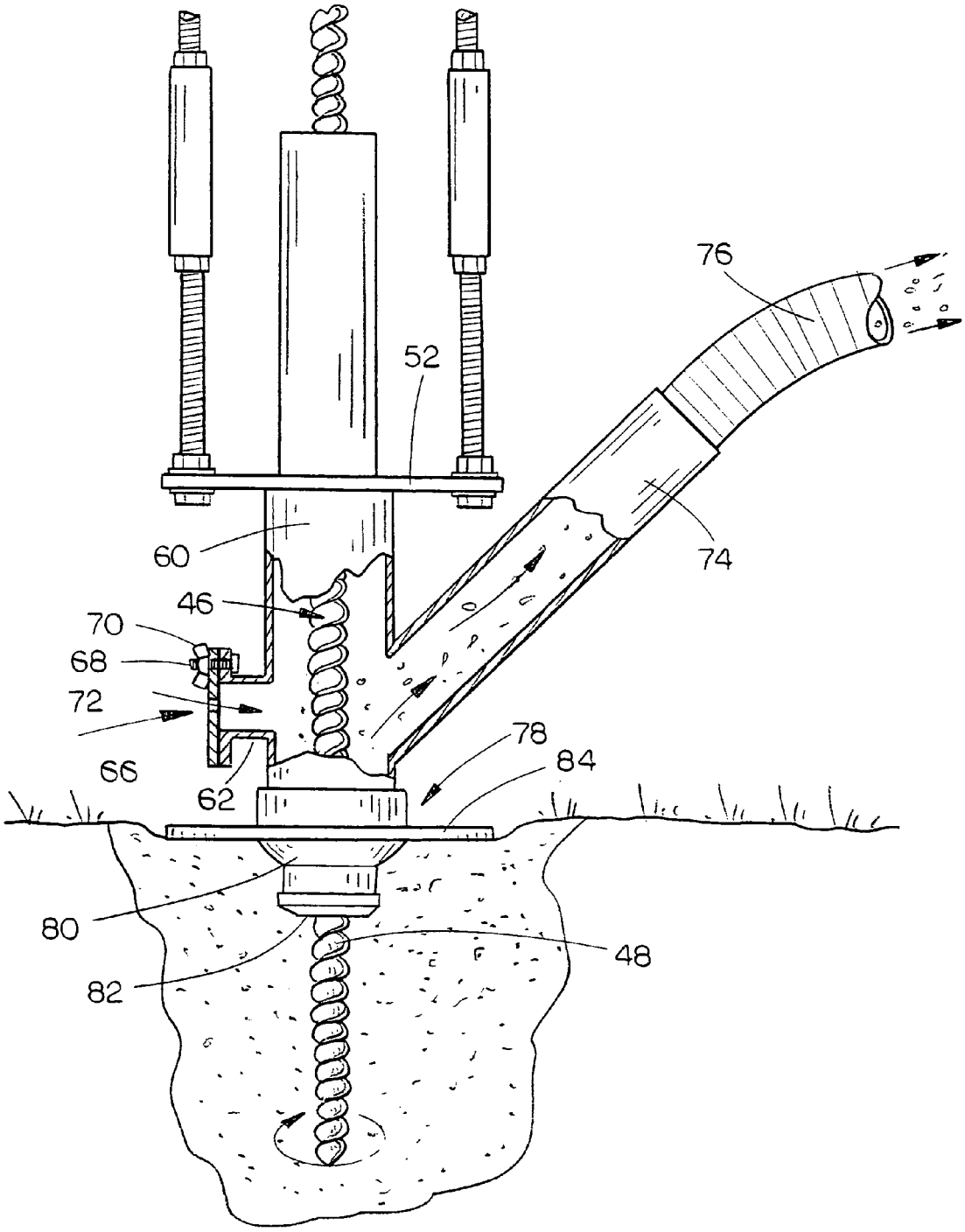
FIG. 8 is a rear view of a portion of the device with portions thereof cut away to more fully illustrate the invention.

The outer ends of parallel arm linkages 18 and 22 are pivotally connected to a vertically disposed frame member or tube 28 by pivot pins 30 and 32 respectively. The outer surface of frame member 28 has a gear rack 34 secured thereto. Support 36 movably embraces frame member 28 and has hydraulic motors 38 and 40 mounted thereon with the power or drive shaft 41 of motor 38 being horizontally disposed and with the power or drive shaft 42 of motor 40 being vertically disposed. The drive shaft of motor 38 has a pinion gear 43 mounted thereon which is in engagement with the gear rack 34 to enable the support 36 to be moved upwardly or downwardly on frame member 28. A hydraulic cylinder 44 is pivotably connected to mast 16 and lower parallel arm linkage 22 and extends therebetween for raising and lowering frame member 28 and components mounted thereon as seen in FIG. 3. Then numeral 45 refers to a normally closed switch which is mounted on frame member 28 which is in the movable path of support 36. When support 36 is in its uppermost position, support 36 engages switch 45 to open the same. Switch 445 is electrically connected to motor 40 so that when switch 45 is closed, motor 40 will be activated and when switch 45 is open, motor 40 is de-engaged.

A soil auger 46 is secured at its upper end to the drive shaft of hydraulic motor 40 for rotation therewith by any convenient means and includes auger flights or flutes 48. Support 50 is secured to the lower end of frame member 28 for movement therewith. Support 50 includes a plate 52 which is bolted or welded to the lower end of frame member 28 and extends horizontally outwardly therefrom. The lower ends of length adjustable stabilizing rods 54 and 56 are secured to plate 52 and extend upwardly therefrom. The upper ends of rods 54 and 56 are slidably received by the support 36 in the manner shown in FIG. 4 so that support 36 moves upwardly and downwardly on the rods 54 and 56. In some cases, rods 54 and 56 may not be necessary.

Tube 58 is welded to plate 52 and extends upwardly therefrom. The lower end of tube 58 registers with an opening formed in plate 52. The upper end of a hollow cylindrical container 60 is welded to the underside of plate 52 below tube 58 and has an air inlet fitting 62 extending horizontally therefrom and which has an open outer end 64 to enable air to be drawn into the interior of container 60. The open outer end of fitting 62 is partially selectively adjustably closed by a disc 66 pivotally secured to fitting 62 by bolt 68 and wing nut 70. Disc 66 is provided with a central opening 72 which has a diameter less than the diameter of the open outer end 64 of fitting 62. Vacuum tube or fitting 74 is secured at its lower end of container 60 and is in communication with the interior of container 60. Vacuum hose 76 is connected to the upper end of tube 74 and extends therefrom as will be described in greater detail hereinafter.

The numeral 78 refers to a shoe-like device which is secured to the lower end of container 60. Device 78 includes a pipe or tube reducer 80 having an open lower end 82 with the diameter of lower end 82 being less than the diameter of the lower end of container 60. Plate or shoe 84 is welded to reducer 80 just above the reduced diameter portion thereof and acts as an outrigger shoe.

Vacuum hose 76 extends from container 60 to a vacuum soil collection chamber 86 which is secured to the roll bar frame 14 of vehicle 12. Vacuum is created within the vacuum chamber 86 by a conventional electric vacuum motor assembly 88 including an air exhaust fitting 89. Vacuum soil collection chamber 86 includes a funnel shaped portion 90 at its lower end which has an open lower end 91. Carousel support 92 is secured to the side of funnel-shaped portion 90 of vacuum soil collection chamber 86. Carousel 94 is rotatably supported, about a vertical axis, on support 92 and includes a disc-shaped plate 95 having a plurality of openings 96 formed therein which are adapted to register with the lower open end of the funnel-shaped portion 90 or vacuum chamber 86. A container 98 is secured to plate 95 beneath each of the openings 96 and have a spring-loaded trap door 100 which normally closes the open lower end of the container 98 but which may be manually opened to permit the retrieval of the sample therein. There may be situations where only a single container 98 will be used thereby eliminating the need for the carousel. Further, if only two containers 98 are needed, the carousel may be replaced by a reciprocating mechanism to place one of the containers 98 beneath the lower open end of the funnel shaped portion 90.

Figure 9:
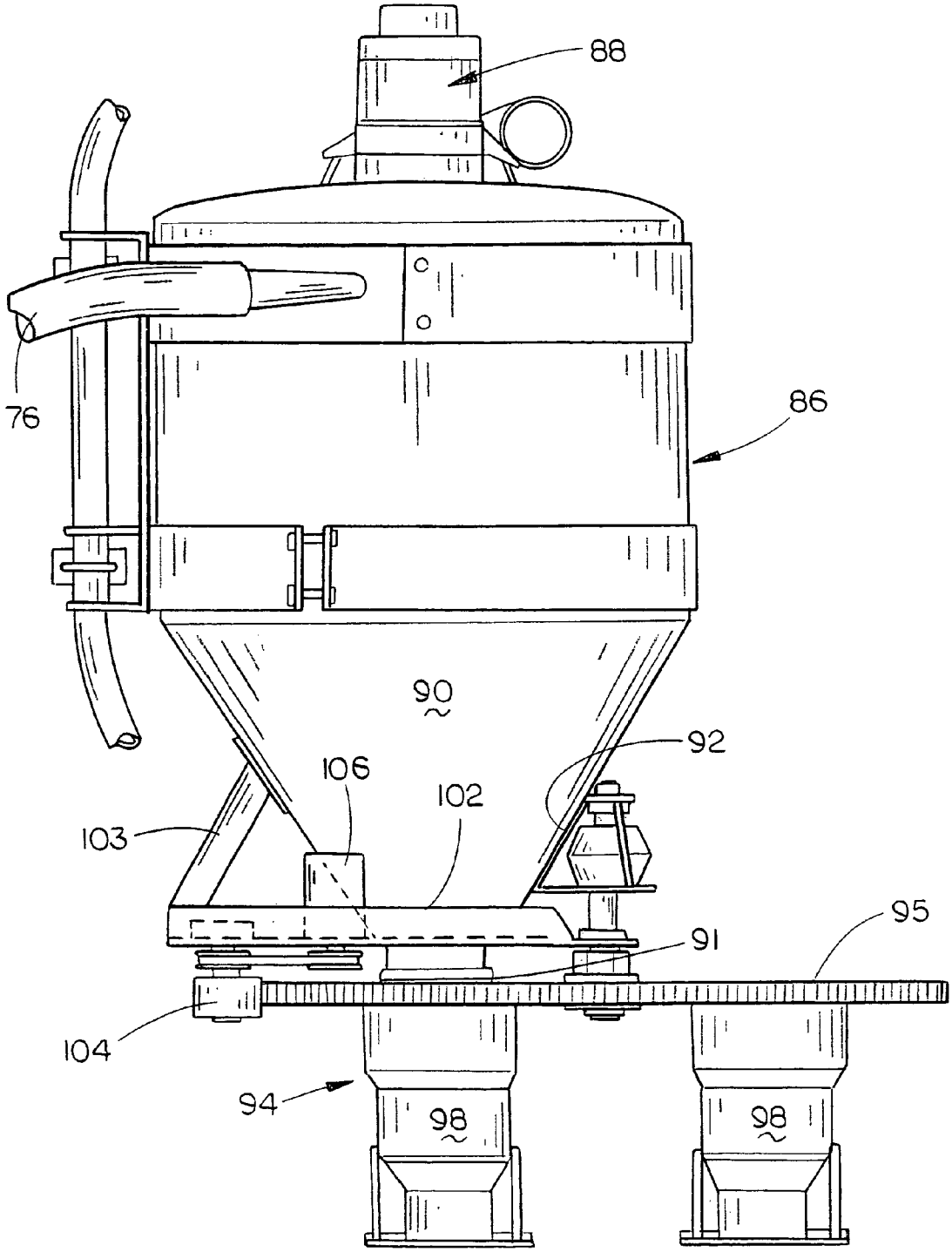
FIG. 9 is a side view of the vacuum soil collection portion of the device of this invention.
Figure 10:
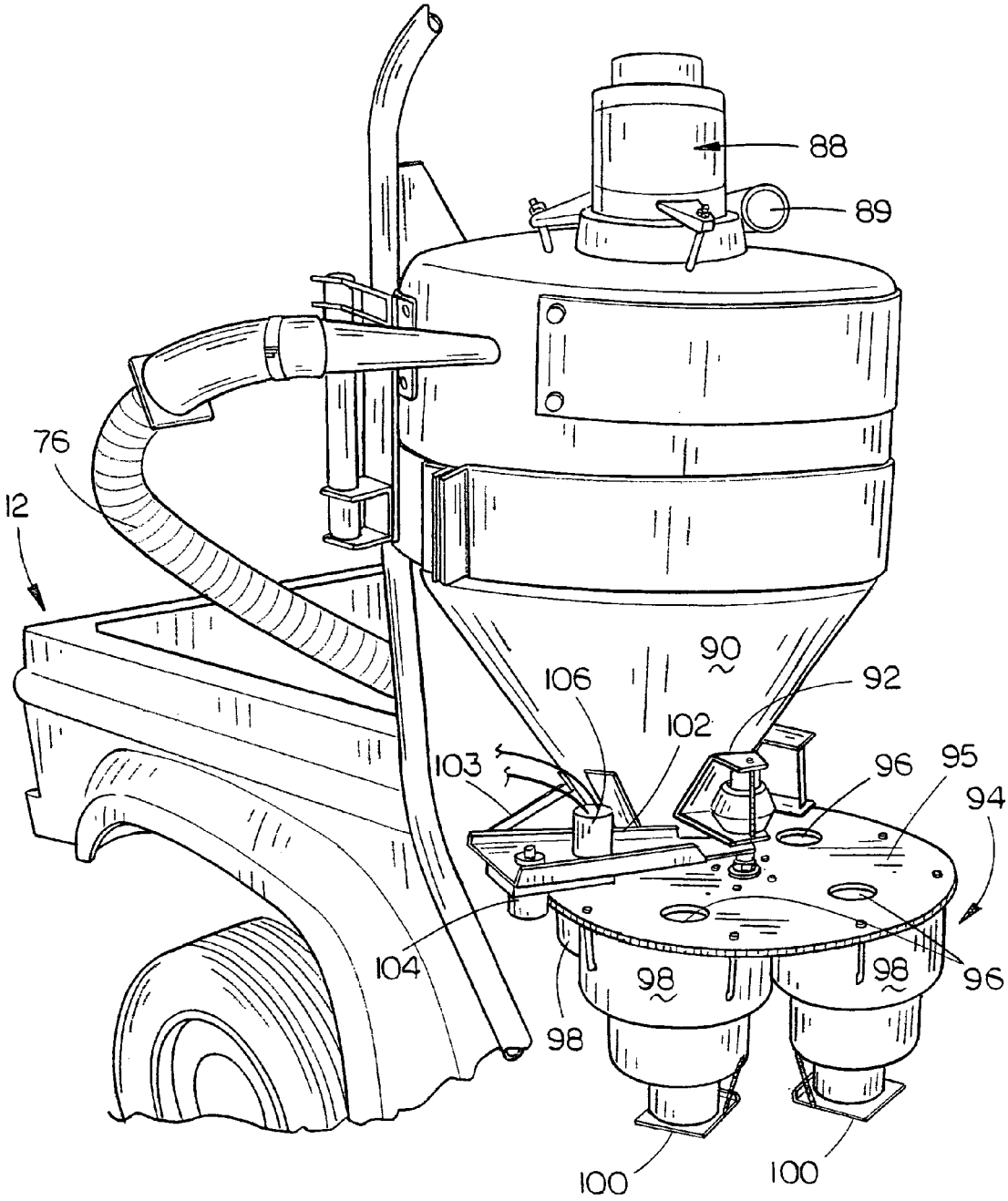
FIG. 10 is a perspective view of the vacuum soil collection device.

A support 102 has its inner end secured to support 92 and extends horizontally outwardly therefrom. The outer end of support 102 is secured to the reduced diameter portion 90 by brace 103. Drive wheel 104 is rotatably secured, about a vertical axis, to the outer end of support 102 which is in driving engagement with the periphery of disc 96. A 12 volt electric motor 106 is operatively connected to drive wheel 104 as seen in FIG. 9 for selectively driving the same to cause the rotation of the carousel 94 with respect to the vacuum soil collection chamber 86. Preferably, the vehicle is equipped with an electric generator 108 and a hydraulic power unit 110 for operating the various motors.

The normal method of operating the soil sampling device of FIGS. 1-10 is as follows. The device 10 will normally be in the position illustrated in FIG. 3 during the transport of the device to the location where the soil samples are to be taken. When the vehicle has been driven to the desired location, the generator 108 and the hydraulic pump unit 110 will be actuated if they have not already been actuated. Since support 36 is in its uppermost position, motor 40 will be de-engaged. The actuator 44 is then extended so that the device 10 is moved downwardly through the parallel arm linkages 18 and 20. The frame member 28 is lowered until plate 84 is in engagement with the ground. Plate 84 acts as an outrigger shoe to maintain the sampler in a vertical position with some of the weight of the vehicle being imposed on the outrigger shoe. The reducer 80 will be forced into the ground around the hole to be drilled which prevents contamination of the sample. The support 36 is lowered with respect to frame member 28 through the actuation of the motor 38 which causes the pinion gear 43 to travel along the length of the gear rack 34. As support 36 moves downwardly on frame member 28, switch 45 closes to activate motor 40 to cause the rotation of auger 46. With the shoe 84 in ground engagement, the motor assembly 88 on the soil collection chamber 86 will be actuated which causes a vacuum to be created within the chamber 86 and within the interior of container 60. The motor 40 by being actuated causes the rotation of the auger 46 with the rotation of the auger 46 causing the auger to dig downwardly into the soil. As the auger 46 digs downwardly into the soil, the motor 38 is actuated to lower the auger to the desired depth. Normally, an adjustable limit switch will be mounted on frame member 28 to stop the lowering of the auger 46 so that the soil sample is taken at the desired level. The flights or flutes 48 of the auger 46 cause the soil being sampled to move upwardly into the container 60. The vacuum within the container 60 causes the soil sample to pass through the conduit 76 to the interior of chamber 86. Once in the chamber 86, the soil will drop downwardly through the open lower end thereof into the container 98 which is positioned below the opening 96 in disc 95 which has been placed into register with the open lower end of the reduced diameter portion 90 of chamber 86. The sample within container 98 may be selectively removed therefrom by opening the trap door 100 as desired. The disc 95 will be rotated with respect to the chamber 86 so that individual samples may be placed in individual containers 98.

The amount of air permitted to enter the interior of container 60 may be selectively varied by pivoting the disc 66 with respect to the fitting 62 to increase or decrease the amount of air entering the interior of fitting 62 through the opening 64. If the disc 66 is in its closed position, air will still be permitted to enter the interior of fitting 62 through the opening 72.

When the desired sample has been taken, motor 40 will normally be deactivated and the motor 38 will be reversed to cause the support 36 to be moved upwardly with respect to the frame member 28. The actuator 44 will also be retracted which will cause the frame member 28 to be raised so that the entire device is moved upwardly with respect to the ground to enable the device to be moved to a different soil sampling location. When support 36 engages switch 45, motor 40 is de-engaged.

In the modified form of the invention, which is the subject of this application and which is shown in FIGS. 11-14, the numeral 112 refers to the auger flute cleaning apparatus which is mounted on the support 50' which replaces support 50. Support 50' is secured to the lower end of frame member 28. In the embodiment of FIGS. 11-14, the elements 54, 56 and 58 have been eliminated.

Apparatus 112 includes a plate 114 which is secured to support 50' by bolts 116. Plate 114 includes a central hub portion 118 having a bearing 120 mounted therein. Bushing 122 is positioned in bearing 120 so as to be rotatable with the inner race thereof. Bushing 122 includes a central bore 124 extending therethrough. Bushing 124 has at least one or more internally threaded openings 126 formed therein which receive set screws 128 therein. The number of openings 126 will depend upon the number of flutes 48 which are formed in the soil auger 46. The inner ends of the screws 128 are received in the flutes 48 of soil auger 46.

Collar 130 is positioned on bushing 122 above the upper end of bearing 120 and hub portion 118 and is secured to bushing 122 by set screw 132 extending through internally threaded opening 134 with the inner end of screw 132 engaging the bushing 122.

Soil auger 46 extends downwardly through collar 130 and bushing 122 with the screws 128 being received by the flutes 48. As the auger 46 is rotatably moved downwardly into the soil, the collar 130, bushing 122 and the inner race of bearing rotates due to the engagement of the screws 128 with the flutes 48. After the soil sample has been taken, the auger 46 is moved upwardly with respect to supports 50' and apparatus 112. As the auger 46 is moved upwardly, the bushing 122 rotates with the screws 128 causing soil in the flutes 48 to be removed therefrom. The soil removed from the flutes 48 will fall downwardly into the container 60 for subsequent delivery to the soil sample collecting apparatus thereby eliminating the need for the operator to manually remove the soil from the flutes 48. The removal of the soil from the flutes 48 prevents the contamination of the next soil sample.

Thus it can be seen that the invention accomplishes at least all of its stated objectives.

I claim:

1. A soil sampling device for use with a wheeled vehicle, comprising;

an upstanding mast attached to the vehicle and having upper and lower ends;

vertically spaced-apart upper and lower parallel arms linkages having inner and outer ends;

said inner ends of said upper and lower parallel arm linkages being pivotally secured, about horizontal axes, to said upstanding mast with said linkages extending outwardly with respect to the vehicle;

an elongated frame member having upper and lower ends;

said outer ends of said upper and lower parallel arm linkages being pivotally secured to said frame member about horizontal axes;

an actuator connected to at least one of said parallel arm linkages to enable said frame member to be vertically moved between upper and lower positions with respect to said mast;

a first support vertically movably mounted on said frame member between upper and lower positions;

a first motor on said first support which is adapted to selectively vertically move said first support with respect to said frame member;

a second support rigidly affixed to said frame member adjacent said lower end thereof;

an elongated vertically disposed auger having upper and lower ends;

said auger having at least one helical flute formed therein;

said upper end of said auger being operatively rotatably secured, about a vertical axis, to said first support;

said auger being vertically movable with said second support so that said auger may be lowered into engagement with the soil;

a second motor on said first support which is adapted to selectively rotate said auger;

a vertically disposed, cylindrical soil collection chamber, having upper and lower ends, mounted on said second support;

said auger vertically movably extending through said soil collection chamber whereby soil augered upwardly by said auger will be collected in said soil collection chamber;

and an auger flute cleaning apparatus mounted on said second support above said soil collection chamber which removes soil from the flute of said auger as said auger is moved upwardly from engagement with the soil;

the soil which is removed from the flute of the auger passing downwardly into said soil collection chamber;

an elongated vacuum conduit having an inlet end and a discharge end;

said inlet end of said vacuum conduit being in communication with the interior of said soil collection chamber;

a vacuum soil collection device mounted on the vehicle adapted to create a collecting vacuum in said vacuum conduit and said soil collection chamber;

said discharge end of said vacuum conduit being in communication with said vacuum soil collection device whereby soil collected in said vacuum collection chamber through the action of said auger will be conveyed to said vacuum collection device.

2. The device of claim 1 wherein said auger has at least a pair of helical flutes formed therein.

3. The device of claim 1 wherein said auger flute cleaning apparatus includes a rotatable tubular bushing having a vertically disposed base formed therein which vertically movably receives said auger therein, said bushing having a cleaner element which extends into said base thereof and into said flute.

4. The device of claim 3 wherein said auger has at least a pair of helical flutes formed therein and wherein said auger flute cleaning apparatus has a pair of cleaner elements extending into said base thereof and into said flutes.

5. The device of claim 4 wherein said pair of cleaner elements extend into said base towards each other.

6. The device of claim 1 wherein said vacuum soil collection device includes a vacuum soil collection chamber having an upper end and an open lower end, and a soil sample collection carousel rotatably positioned at the lower open end of said soil sample collection chamber.

7. The device of claim 6 wherein said carousel includes a horizontally disposed disc which is selectively rotatably about a vertical axis beneath said open lower end of said soil sample collection chamber; said disc having a plurality of radially spaced-apart openings formed therein which may be individually selectively moved into communication with said open lower end of said soil sample collection chamber; and soil sample containers mounted on said disc below said openings in said disc adapted to receive soil samples therein.

8. The device of claim 7 wherein each of said soil sample containers have a selectively closable lower open end.

9. The device of claim 8 wherein spring loaded trap doors close the lower open ends of said containers.

10. The device of claim 7 further including a motor operatively connected to said disc which selectively rotates said disc.

11. The device of claim 1 wherein said frame member has a vertically disposed gear rack positioned thereon and wherein said first motor includes a driven gear which meshes with said gear rack.

12. The device of claim 1 wherein an outrigger shoe is mounted on said second support which is brought into ground engagement when said frame member is in its said lower position.

13. The device of claim 1 wherein said second support has a downwardly extending soil penetration member which is driven into the ground when said frame member is moved to its said lower position.

14. The device of claim 1 wherein said soil collection chamber has an adjustable ambient air inlet mounted thereon.

15. The device of claim 1 wherein said second support has a downwardly extending soil penetration member which is driven into the ground when said frame member is moved to its said lower position; said soil penetration member having a lower open end through which said auger may be extended.

* * * * *